US010231480B1

(12) United States Patent
Parcevaux

(10) Patent No.: US 10,231,480 B1
(45) Date of Patent: Mar. 19, 2019

(54) HANDHELD CIGARETTE-MAKING MACHINE

(71) Applicant: REPUBLIC TOBACCO L.P., Glenview, IL (US)

(72) Inventor: Philippe Parcevaux, Cabestany (FR)

(73) Assignee: REPUBLIC TOBACCO L.P., Glenview, IL (US)

( * ) Notice: Subject to any disclaimer, the term of this patent is extended or adjusted under 35 U.S.C. 154(b) by 211 days.

(21) Appl. No.: 15/262,527

(22) Filed: Sep. 12, 2016

(51) Int. Cl.
*A24C 5/06* (2006.01)
*A24C 5/42* (2006.01)

(52) U.S. Cl.
CPC ..... *A24C 5/425* (2013.01); *A24C 5/06* (2013.01)

(58) Field of Classification Search
None
See application file for complete search history.

(56) References Cited

U.S. PATENT DOCUMENTS

| | | | |
|---|---|---|---|
| 5,398,701 | A | 3/1995 | Neumann et al. |
| 2004/0099276 | A1 | 5/2004 | Parcevaux |
| 2004/0200485 | A1 | 10/2004 | Garbarino |
| 2011/0192406 | A1 | 8/2011 | Neumann |

FOREIGN PATENT DOCUMENTS

DE 202012102605 U1 10/2013

OTHER PUBLICATIONS

Extended European Search Report from the European Patent Office for Application No. 17190642.3 dated May 17, 2018 (11 pages).
Partial European Search Report from the European Patent Office for Application No. 17190642.3 dated Feb. 8, 2018 (12 pages).

*Primary Examiner* — Dennis R Cordray
(74) *Attorney, Agent, or Firm* — Michael Best & Friedrich LLP

(57) ABSTRACT

A handheld cigarette making machine with a longitudinally sliding member that moves between a distal loading position for receiving loose tobacco and a proximal filling position having an adjustment member that enables the machine to fill cigarette tubes of two different tobacco-receiving portion lengths using a single length tobacco-receiving cavity and tamping member and a base for tabletop operation of the machine.

11 Claims, 15 Drawing Sheets

HANDHELD CIGARETTE-MAKING MACHINE

FIELD

This invention relates to handheld cigarette-making machines.

BACKGROUND

Handheld cigarette making machines are used to economically and efficiently fill empty filter-tipped cigarette tubes with tobacco. Since smokers typically prefer cigarettes (and use corresponding empty cigarette tubes) in two different filter lengths which result in two different tobacco-receiving portion lengths or in two different overall cigarette tube lengths, various approaches have been suggested to enable handheld cigarette making machines to accommodate the different tobacco-receiving portions of the tubes. These approaches are typically implemented in handheld machines that are complex and expensive to manufacture and use since it has been universally believed in the past that it is necessary to adjust the length of the cavity for receiving tobacco, the length of the tamper for compressing tobacco in the machine, and the length of the movement or throw distance of the device on filling a cigarette tube to correspond to different tube tobacco-receiving portion lengths.

If an easy to manufacture and use handheld cigarette-making machine that uses a single throw distance and a single tamper length to accommodate at least two different cigarette tube tobacco-receiving portion lengths could be developed, an important advance in the art would be at hand. Embodiments of the present invention comprise such easy to manufacture and use handheld cigarette making machines using a single throw distance and a single tamper length. These and other features and advantages are evident from the following description of embodiments of the invention, with reference to the accompanying drawings.

SUMMARY OF THE INVENTION

Embodiments of the invention include a handheld cigarette-making machine with a base and a member mounted in the base for sliding longitudinally. The maximum sliding distance of the sliding member is referred to as the "throw distance" of the machine and corresponds to the distance between a distal loading position of the sliding member in which loose tobacco may be placed in the machine and a proximal sliding member filling position in which the tobacco fills the empty portion of a cigarette tube.

The sliding member has an elongated cavity for receiving loose tobacco and a cigarette tube holding assembly for attaching empty cigarette tubes with different tobacco-receiving portion lengths. A top member is mounted to the sliding member for pivoting between an open position and a closed position. This top member has an elongated tamping member attached to its lower surface to compress loose tobacco in the sliding member cavity when the top member is pivoted to its closed position. The length of this tamping member is not variable and is shorter than that of prior machines that accommodate different sized empty tobacco-receiving tube portions. The present tamping member serves for filling empty cigarette tube portions of varying tobacco-receiving lengths.

Finally, an adjustment member is mounted in the sliding member for adjusting the length of the elongated cavity as necessary to fill empty cigarette tubes of different tobacco portion lengths without varying the throw distance. In embodiments, the machine will accommodate two different tobacco-receiving tube portion lengths and the adjustment member is mounted for movement between a distal retracted position corresponding to a shorter tube tobacco-receiving portion length and a proximal fully open position corresponding to a longer tube tobacco-receiving portion length.

In embodiments, the adjustment member has a distal face and the base has a tobacco abutment member with a distal end that cooperates with the adjustment member distal face to form a proximal end of the tobacco receiving cavity.

In embodiments, the adjustment member has at least one downwardly directed protuberance and the sliding member has a sidewall with spaced slots for engaging the protuberance in distal and proximal positions corresponding to shorter and longer cigarette tube tobacco-receiving portion lengths.

DETAILED DESCRIPTION OF PREFERRED EMBODIMENTS

Figure 1:
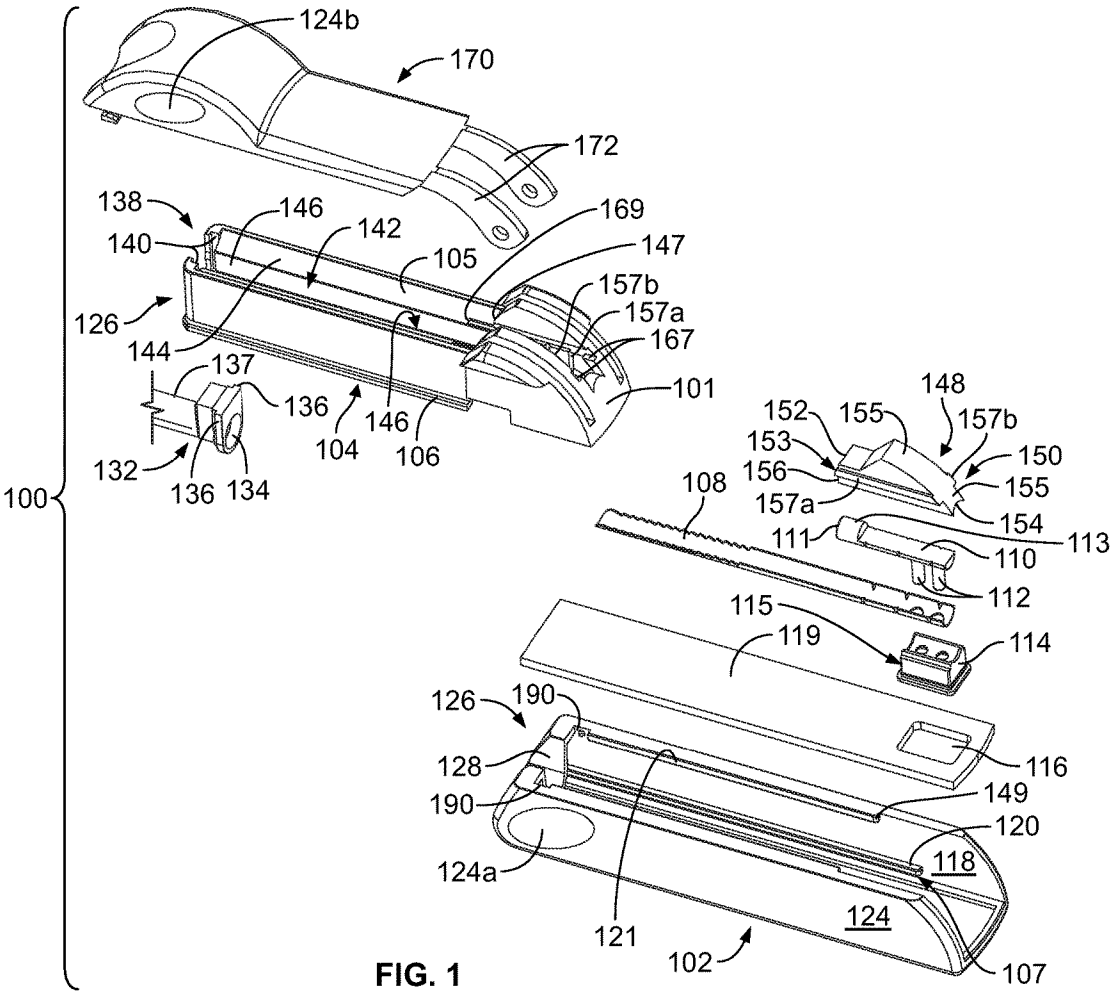
FIG. 1 is an exploded view of a handheld cigarette-making machine in accordance with embodiments of the invention.

Turning first to the exploded view of FIG. 1, a handheld cigarette making machine 100 is shown. Machine 100 includes a base 102 and a sliding member 104 that is mounted to the base 102 as will be described below. Sliding member 104 has sidewalls 105 at its opposite lateral edges. The sidewalls have outwardly directed ribs 106. Base 102 in turn has upstanding opposite inner sidewalls 118 with inwardly directed ribs 120 near the bottom of each of the inner sidewalls. Ribs 120 define a slot 107 between the bottom surface of the ribs and a bottom wall 119 that is positioned in the bottom of the base as it is placed into the tobacco receiving cavity. Ribs 106 of the sliding member are dimensioned to be received in slots 107 to permit the sliding member to be moved proximally and distally in the base. The full range of movement of the sliding member is its "throw distance" between its initial distal loading position in which loose tobacco may be placed in the machine and its proximal filling in which tobacco is loaded into an empty tube. Once the cigarette tube is filled the sliding member is returned to its initial or distal loading position so that the tobacco filled cigarette tube may be removed from the machine.

A concave spoon 108 is mounted to base 102 with a tobacco abutment member 110 positioned at the proximal end of the spoon. The spoon is designed to rest in a concave receiving surface of pin holder block 114 that is mounted in a receiving cavity 116 in bottom wall 119 of the base. The proximal end of the spoon is captured between tobacco abutment member 110 and pin holder block 114 and held in place by downwardly directed abutment pins 112 which pass through a pair of holes 109 in the spoon and are affixed in pin holder block 114. The abutment member includes a circular portion 113.

The pin holder block 114 includes a distal surface 115 that cooperates with sliding member surface 113 (FIG. 2) to limit proximal movement of the sliding member on the base.

Inner sidewalls 118 of base 102 also include inwardly directed ribs 121 running along the top edges of the sidewalls. Inwardly directed ribs 121 limit lateral movement of the sliding member within the base as it moves proximally and distally therein. Base 102 also includes outer sidewalls 124 with elliptical depressions 124*a* to assist the user in grasping and holding the base.

Figure 4A:
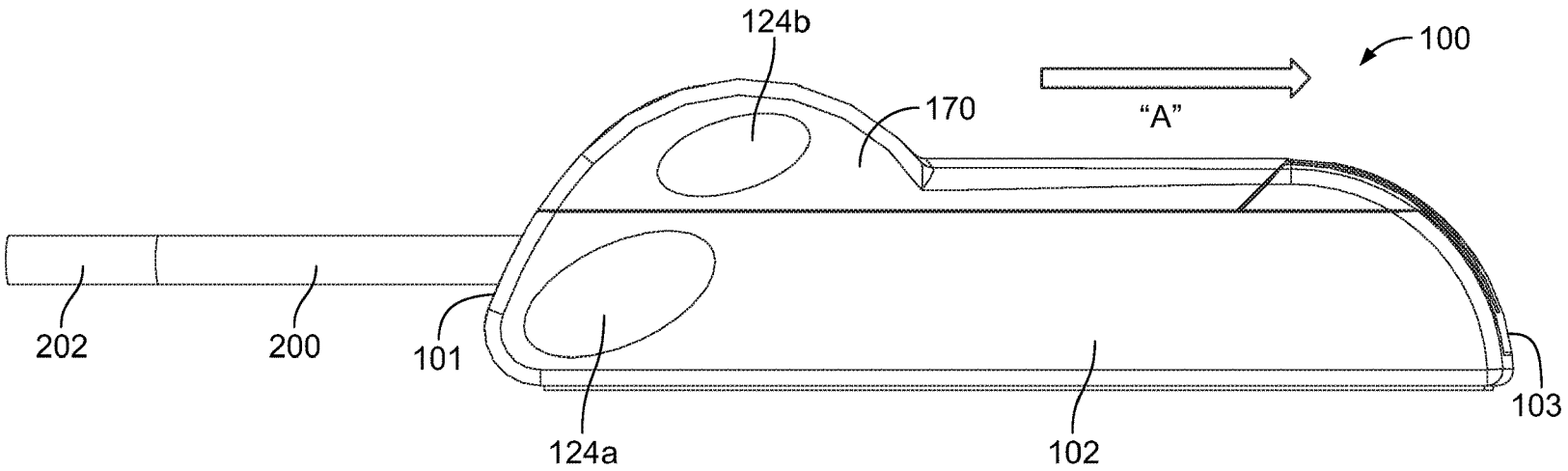
FIG. 4A is a side elevation view of a fully assembled cigarette-making machine in accordance with FIG. 1 with its sliding member in a distal loading position and a cigarette tube attached to the machine.

The base has a front end 126 with a cigarette tube clearance slot 128. A cigarette tube holding nipple assembly 132 is mounted in nipple assembly side rail receiving slots 140 in sliding member 104. The assembly includes a throughhole 134 and nipple side rails 136 that are received in slots 140. The assembly further includes a tube portion 137 dimensioned to be received in the open end of an empty cigarette paper tube 200 (FIG. 4A) or 200*a* (FIG. 5E) with a filter 202 at its distal end.

Sliding member 104 has an inner generally rectangular tobacco receiving cavity 142 of adjustable length into which loose tobacco will be placed by a user before compressing and transferring the tobacco into the empty filter-tipped cigarette tube, as will be explained below. The tobacco receiving cavity has a circular bottom surface 143 (FIG. 5A) abutting the bottom surface of spoon 108. Tobacco receiving cavity 142 includes downwardly directed curved inner walls 144 which help direct the loose tobacco into the bottom of the tobacco receiving cavity as it is placed into the tobacco receiving cavity and lightly compressed, as appropriate, before closing pivoting top member 170. Finally, distal movement of the sliding member on the base is a limited by engagement between abutment surface 147 of the sliding member and abutment end 149 of base rib 121.

Figure 2:
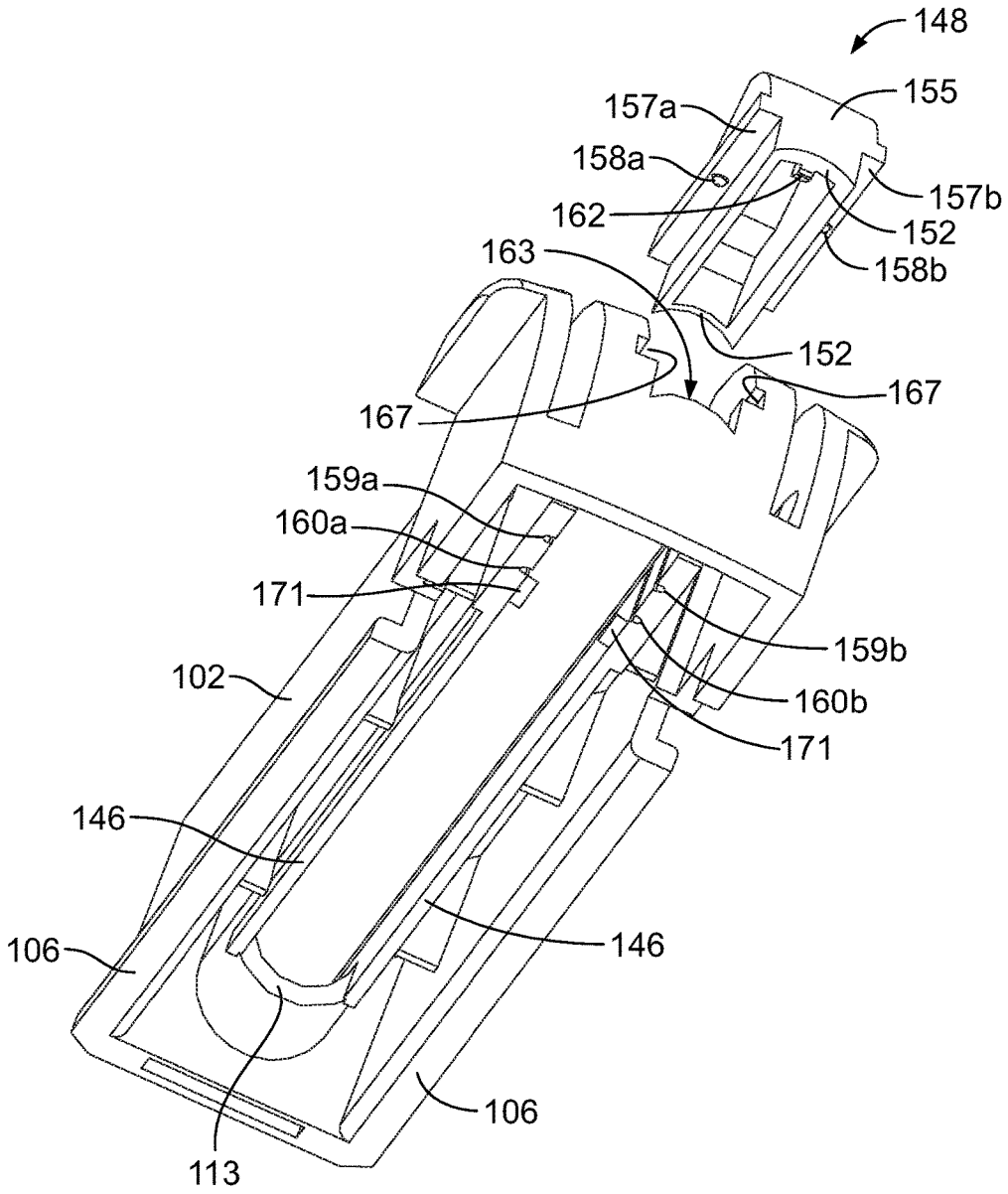
FIG. 2 is a bottom perspective view of a partially assembled cigarette-making machine in accordance with the embodiment of FIG. 1.
Figure 3A:
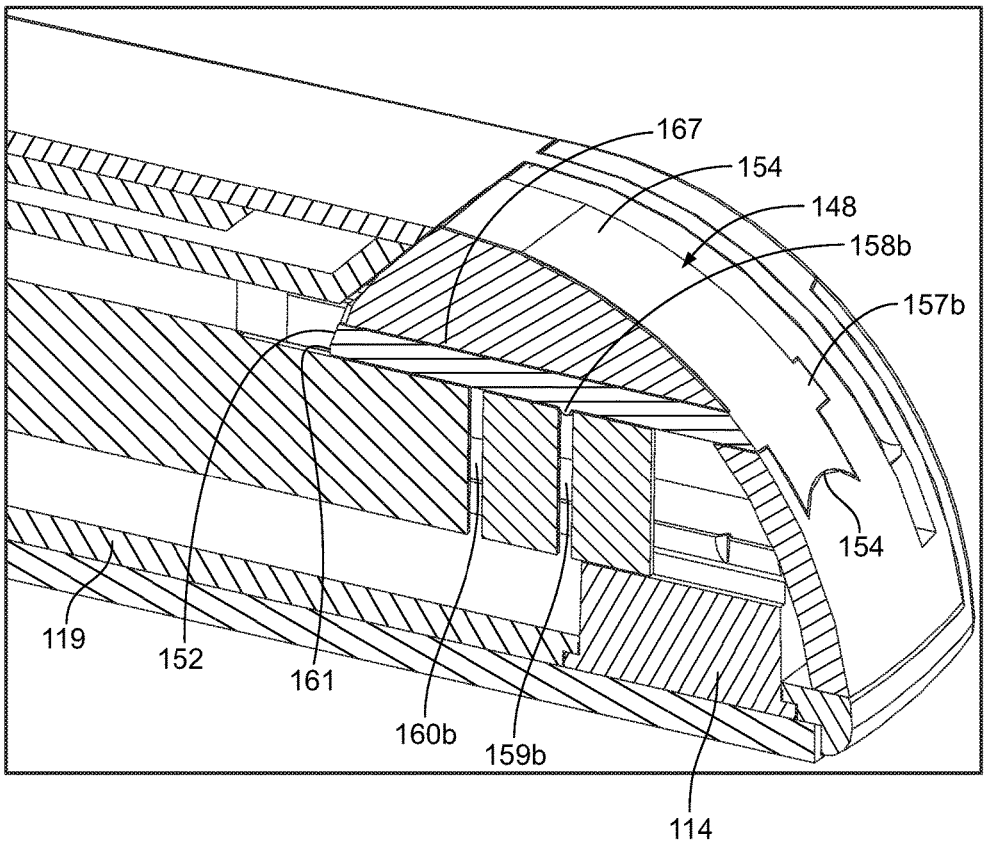
FIG. 3A is a cutaway view of the proximal end of a cigarette-making machine in accordance with FIG. 1 taken along line 3A-3B of FIG. 5C in which the adjustment member is in its proximal fully open position and FIG. 3B is a view corresponding to that of FIG. 3A in which the adjustment member is in its distal retracted position.

Handheld cigarette making machine 100 includes an adjustment member 148 which is illustrated, inter alia, in FIGS. 1, 2 and 3A-3B. Adjustment member 148 has a proximal end 150, a distal end 152, and hemispherical cut-outs 153 and 154 in its distal and proximal end walls. The adjustment member also includes a convex, proximally facing top surface 155 and a generally flat distal abutment surface 156 above cut out 153. Additionally, adjustment member 148 has outwardly directed ribs 157*a* and 157*b* and downwardly directed protuberances 158*a* and 158*b* (FIG. 3A). When the adjustment member is in position in the sliding member, ribs 157*a* and 157*b* will be positioned in slots 167 of sliding member sidewalls 105 to enable the adjustment member to be moved proximately and distally in sliding member 104.

Figure 3B:
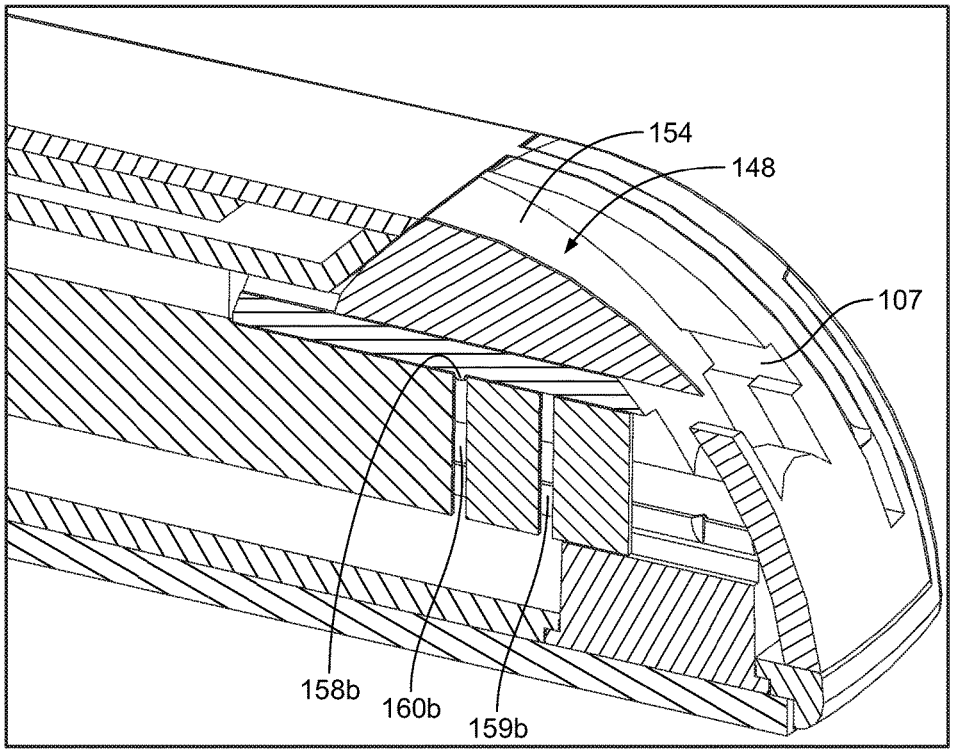

Enlarged cross-sectional views of a proximal portion of a cigarette making machine 100 with adjustment number 148 in its predetermined proximal and distal positions corresponding to predetermined empty cigarette tube portions are shown in FIGS. 3A and 3B. Adjustment member 148 insures that the amount of loose tobacco 142 will correspond to the empty tobacco-receiving portion of the cigarette tube chosen.

Handheld cigarette making machine 100 has a top pivoting member 170 (FIG. 1) with a pair of rearwardly directed pivot arms 172. Member 170 is attached to sliding member 104 for pivoting movement with respect to the sliding member. An elongated downwardly directed cigarette tamping member 178 is located on the bottom surface 176 of pivoting top member 170 as can be seen, for example, in FIG. 5A. The tamping member has a concave elongated lower surface 180 of a single length corresponding to the shorter pre-determined length of tobacco receiving cavity 142 when the adjustment member is in its distal position, as will be explained below.

Figure 5A:
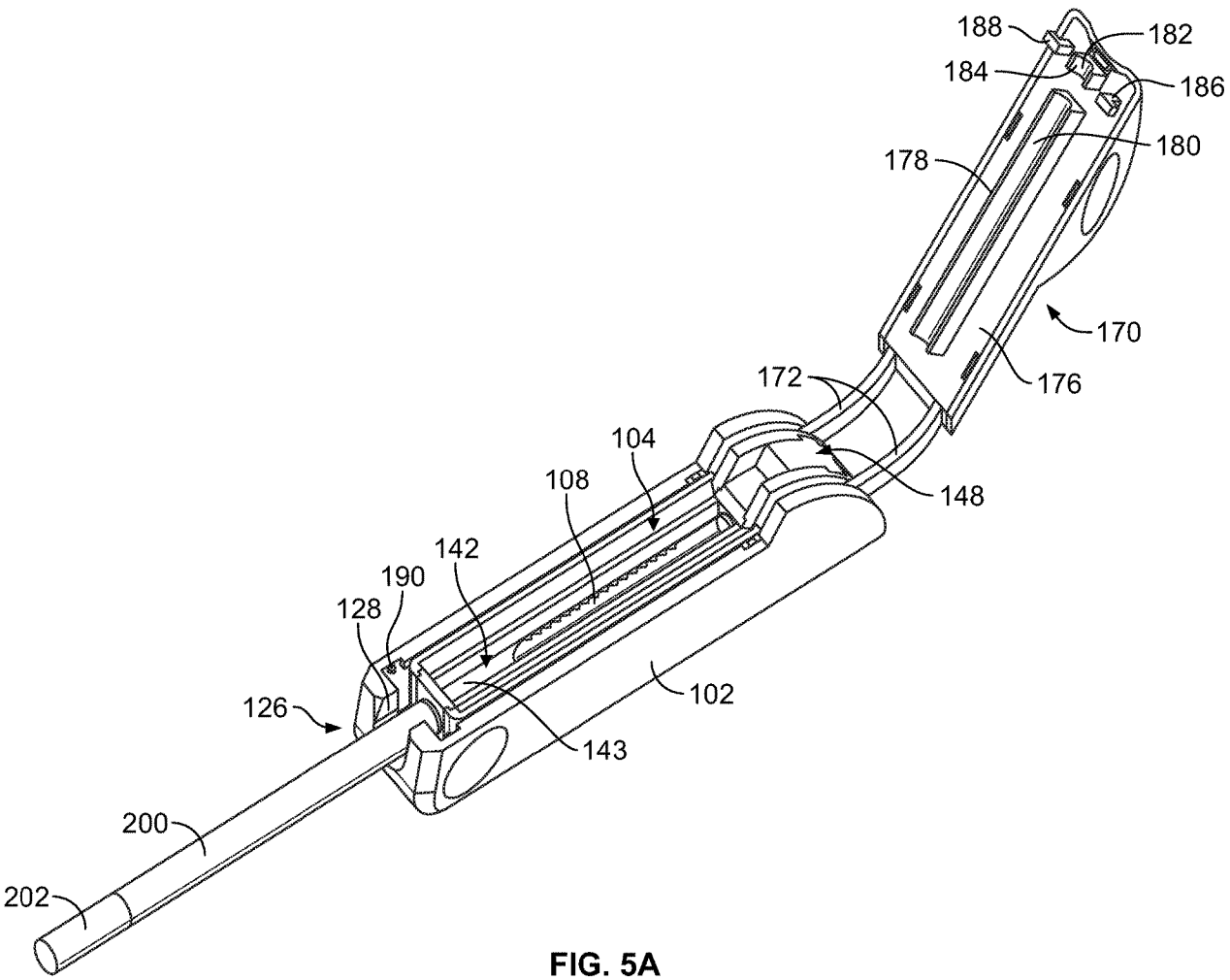
FIGS. 5A and 5B are perspective views of an assembled cigarette-making machine in accordance with FIG. 1, with the machine in its start or rest position and its cover opened, before and after placement of loose tobacco into the machine with the adjustment member in its proximal fully open position.

A downwardly directed elastomeric cigarette tube holding member 182 is also positioned on bottom surface 176 (FIG. 5A). This elastomeric cigarette tube holding member has a concave surface 184 positioned to engage the outer surface of the open end of a cigarette tube when it is mounted to nipple tube portion 137 to prevent the tube from pulling away from the machine as compressed tobacco is being moved into the tube.

Cigarette making machine 100 is shown in a bottom perspective view in FIG. 2, with bottom wall 119 of base 102 removed to facilitate viewing of adjustment member 148 in a pre-assembly position. When the adjustment member is assembled in the sliding member, its ribs 157*a* and 157*b* will be positioned in slots 167 of sliding member sidewalls 105. This view also shows proximal vertically oriented protuberance-receiving slots 159*a* and 159*b* and vertically oriented distal protuberance-receiving slots 160*a* and 160*b* in internal sidewalls 146 of sliding member 104. These slots receive protuberances 158*a* and 158*b* as adjustment member 148 is moved between its proximal and distal positions acting as temporary stops for the sliding member in its proximal and distal positions. Since the protuberances are rounded, the slots resist movement of the adjustment member only until a user applies sufficient force to move the rounded edges of the protuberances up along an edge of the slot to displace the protuberances from the pair of slots in which they are then resting and moved into engagement with the other pair of slots.

This view also illustrates downwardly directed adjustment member stop 162 which abuts the inner surface 163 of proximal wall 165 of the sliding member when the adjustment member is in its proximal position with protuberances 158*a* and 158*b* sitting in proximal protuberance-receiving slots 159*a* and 159*b*. When the adjustment member is in its distal position with the protuberances sitting in the distal protuberance-receiving slots, outwardly directed adjustment member ribs 157*a* and 157*b* will abut endpoints 169 of slots 167, to prevent distal movement beyond this point. Stops 171 which project inwardly from sliding member internal sidewalls 146 further limit distal movement of the adjustment member by engaging the protuberances adjacent to distal protuberance receiving slots 169*a* and 169*b*.

The movement and containment of the adjustment member is illustrated in the cutaway views of FIGS. 3A and 3B. FIG. 3A shows adjustment member 148 in its proximal position which, as will be explained below, will enable the machine to accommodate and fill the longer of two cigarette tube lengths. In this position, top surface 155 of the adjustment number is flush with the corresponding proximal contour of the sliding member which prevents any inadvertent movement of the adjustment member during the handling of the machine. Protuberances 158*a* (not shown in this view) and 158*b* rest in the top edge of corresponding slots 159*a* (not shown in this view) and 159*b* in sidewalls 146. Distal end 152 of the sliding member includes a flat distal abutment surface 156 as shown which extends into cavity 142 of the sliding member (FIG. 5A) to act as a movable proximal end of the cavity to enable adjustment of the length of the cavity. In this view, the cavity is in its larger longitudinal dimension for filling a longer cigarette/cigarette tube.

Figure 5B:
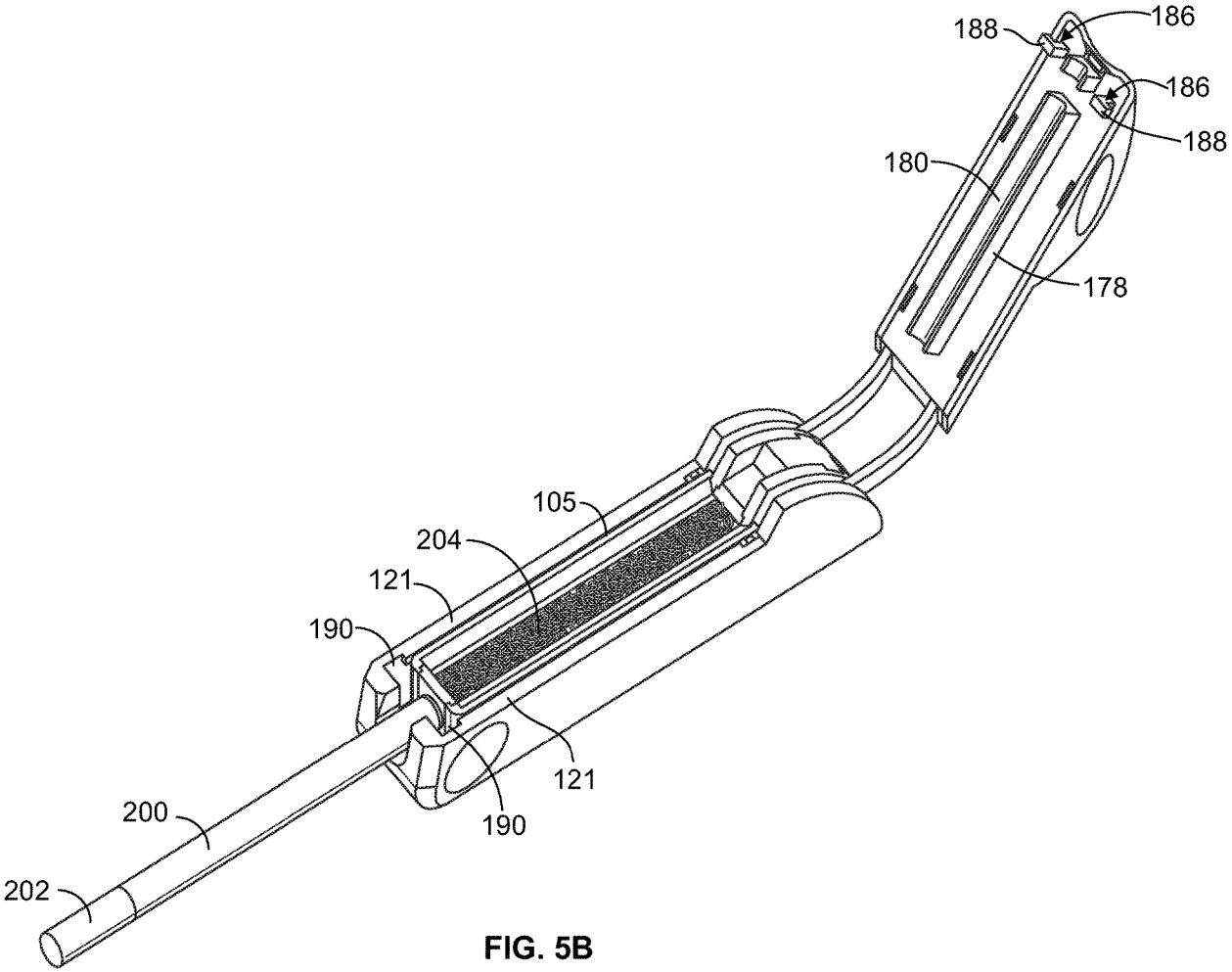
Figure 5C:
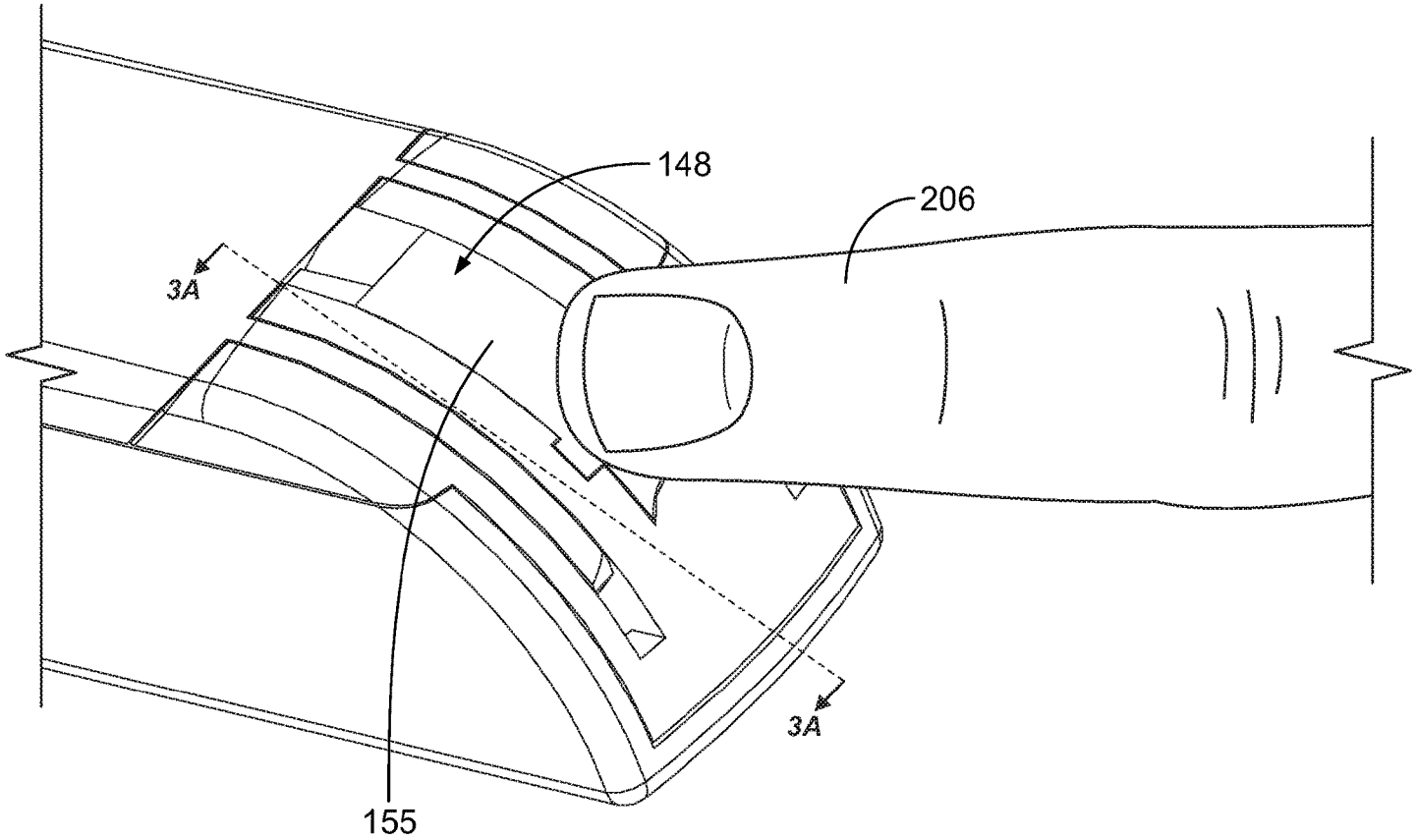
FIGS. 5C and 5D are partial perspective views of the proximal end of a cigarette-making machine in accordance with the above figures in which the adjustment member is in its proximal fully open position and in its distal retracted position.

If a user wishes to fill a shorter cigarette tube tobacco-receiving portion, the user will push adjustment member 148 distally until it reaches and is locked in its most distal position. This can be done by pressing the proximally facing top surface 155 of the adjustment member with the tip of the user's finger 206 as shown in FIG. 5C to apply force to overcome the resistance of the protuberances resting in proximal slots 159*a* and 159*b* to thereby move the adjustment member to the position illustrated in FIG. 3B. As can be seen in this figure, protuberances 158*a* and 158*b* have been moved into engagement with the top edges of slots 160*a* and 160*b*. Further distal movement of the adjustment member is limited by engagement of the distal ends of the adjustment member ribs with the distal ends 169 of slots 167 as well as engagement with stops 171. The length of tamping member 178 corresponds to the resulting shortened length of tobacco receiving cavity 142.

FIGS. 4A, 4B, 5A and 5B show cigarette machine 100 with an empty cigarette tube 200 mounted to the machine. Tube 200 has a filter 202 at its distal end which engages tobacco inserted into the tube at its proximal end, acting as a backstop to facilitate compaction of the tobacco as it is moved into the empty portion of the tube by the machine.

In FIG. 5A, top pivoting member 170 is shown pivoted away from sliding member 104 to reveal empty tobacco receiving cavity 142. Adjustment member 148 is in its proximal position so that the tobacco receiving aperture is in its larger or elongated longitudinal configuration and ready to receive a sufficient amount of loose tobacco to fill the longer portion of empty cigarette tube 200. Distal face 111 of abutment member 110 cooperates with distal end 152 of the adjustment member to close off or form the proximal end of the tobacco receiving cavity in this configuration. FIG. 5B shows the same view, but with loose tobacco 204 generally filling the tobacco receiving cavity.

Figure 6:
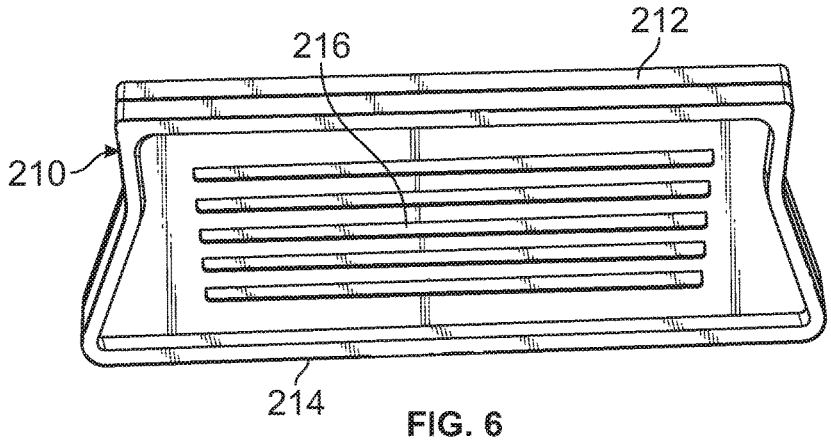
FIG. 6 is an elevation view of a tamper accessory that may be used with embodiments of the invention to tamp cigarette tobacco loaded into the machine before it is compressed and injected into a cigarette tube.

The loose cigarette tobacco in cavity 142 may be tamped in place with a tool like tamper accessory 210 which is illustrated in FIG. 6. Tamper accessory 210 is particularly adapted for use with machine 10 since it includes opposed tamping edges 212 and 214 of two different lengths corresponding to the two different lengths of tobacco receiving cavity 142 obtained by moving adjustment member 148 between its proximal and distal positions to fill two different cigarette tube tobacco-receiving portion lengths. The tamper accessory may be gripped by the user placing his/her thumb and forefinger on opposite sides of the tamper midsection 216 while orienting the appropriately sized tamper edge opposite the loose tobacco in the cavity and manipulating and compressing the loose tobacco to ensure that an appropriate amount of tobacco will be available to fill the empty portion of the cigarette tube.

Figure 5D:
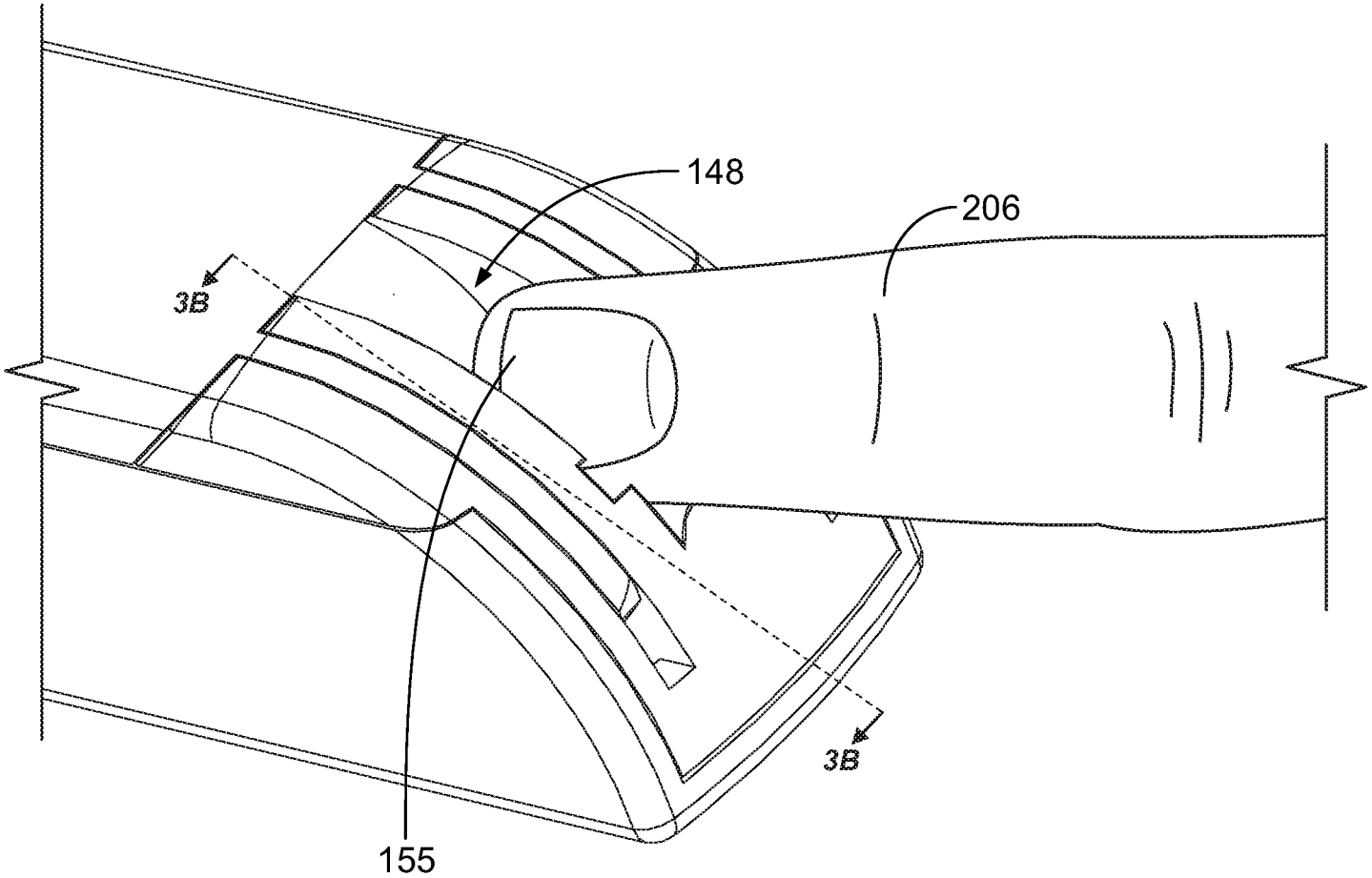
Figure 5E:
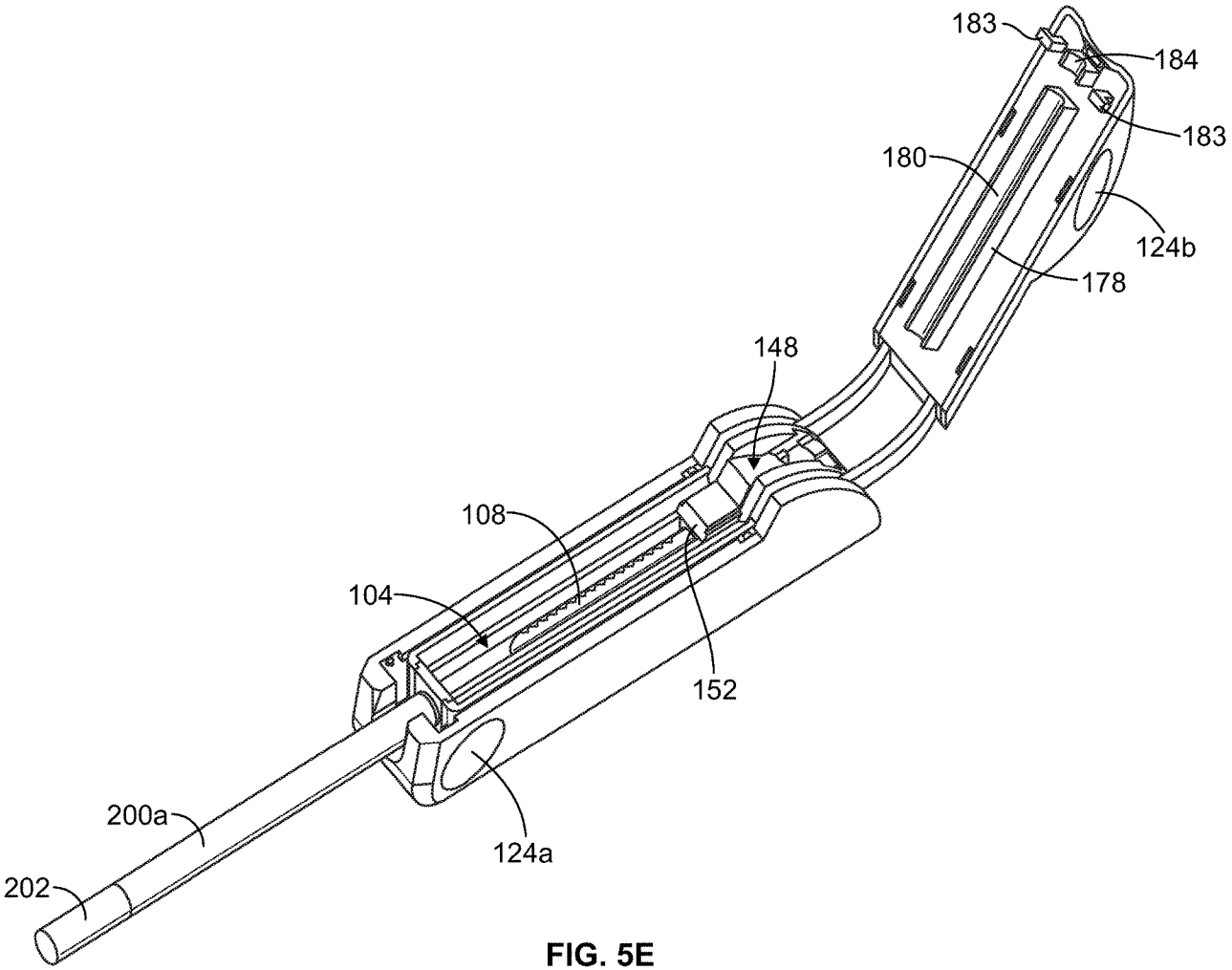
FIGS. 5E and 5F are views corresponding to those of FIGS. 5A and 5B in which the adjustment member 148 is in its distal, retracted position and a cigarette tube is attached to the machine.
Figure 5F:
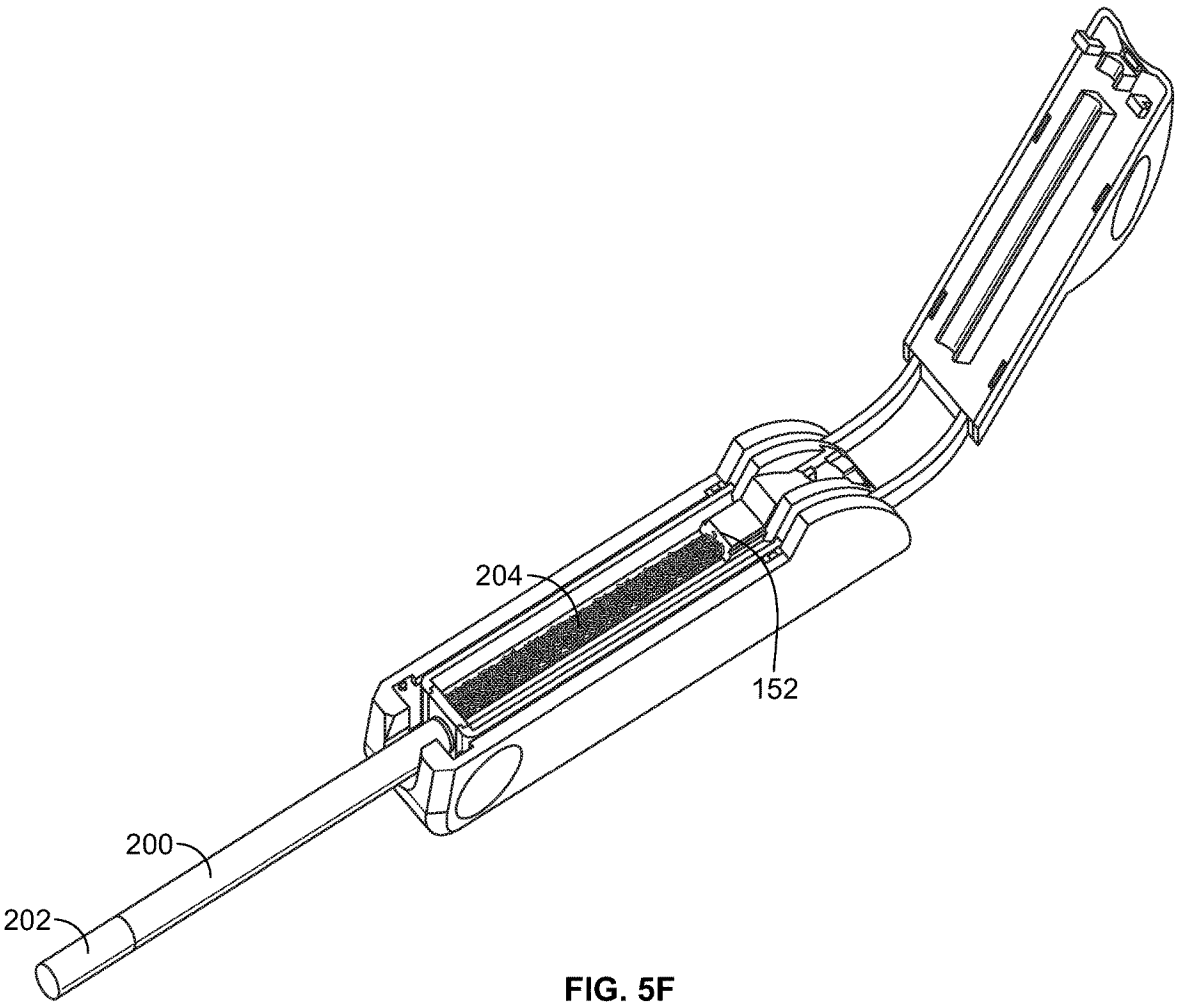

If it is desired to fill a cigarette tube 200*a* with a shorter empty tobacco-receiving portion (as in FIGS. 5D and 5E), a user will press the proximally facing top surface 155 of adjustment member 148 distally, moving it to its most distal position, thereby reconfiguring tobacco receiving cavity 142 to its smaller longitudinal configuration as shown in FIGS. 5D and 5E. Then, cigarette tube 200*a* with the shorter empty portion will be affixed to nipple tube portion 137 of the machine. At this point, loose tobacco will be placed in the shortened empty cavity as illustrated in FIG. 5F to fill the shorter empty portion of cigarette tube 200*a*.

The operation of the machine to fill a cigarette tube 200 (with a longer empty portion) proceeds as follows:

A. Position adjustment member in its proximal location of FIGS. 3A and 5A.

B. Pivot top member 170 upwardly to the position shown in FIG. 5A.

C. Slide the open proximal end of empty cigarette tube 200 onto nipple assembly 132.

D. Place loose tobacco 204 into tobacco receiving cavity 142 as shown in FIG. 5B and preferably tamp with tamper accessory 210.

E. Close top member 170 all of the way down onto the sidewalls 105 of the sliding member so that the outwardly directed catch members 188 of its downwardly directed locking arms 186 clear slots 190 in ribs 121 with the catch members below the bottom surface of the ribs. As the top member is closed, the concave elongated lower surface 180 of tamping member 178 will compress the distal portion of tobacco in the cavity under surface 180 onto the upwardly directed elongated circular surface of spoon 108 forming a compressed cylinder of tobacco (not shown) located between the surface of the spoon and the elongated concave lower surface of the tamping member.

F. The sliding member 104 will then be grasped preferably by pressing the thumb and forefinger of one hand against depressions 124*a* of base 102 while pressing thumb and forefinger of the other hand against depressions 124*b* of the sliding member and, while maintaining the sliding member in the closed position, moving it proximally (direction "A" in FIG. 4A) to draw the cigarette tube along the compressed cylinder of tobacco located between the surface of the spoon and the elongated concave lower surface of the tamping member and then over the remaining tobacco in cavity 142, filling the tube with the available tobacco when the sliding member reaches its proximal filling position depicted in FIG. 4B. The tobacco in the cavity is prevented from moving proximally during this process by proximal face 111 of tobacco abutment member 110. The distal movement of the sliding member will continue until the tube is filled, optionally with the tobacco abutment member partially entering the end of the tube to fully compress the tobacco which will expand slightly when the filled cigarette tube is removed from the machine in the next step. As noted earlier, this full movement of the sliding member between its distal loading position in which tobacco is placed in the machine and its proximal filling position in which a tobacco fills an empty cigarette tube is referred to here as its "throw distance". This throw distance, which remains unchanged during the operation of the machine with the two tubes having different sized empty portions (200, 200*a*), is represented by "B" in FIG. 4B.

G. Finally, sliding member 104 will be moved distally to its rest position and a fully filled cigarette tube removed from the machine.

If it is desired to fill a cigarette tube 200*a* with a shorter empty portion, adjustment member 148 is pressed distally as shown in FIG. 5D and the process proceeds as described above. As noted earlier, the amount of tobacco loaded into tobacco receiving cavity 142 is limited by the shortening of that cavity which extends to the distally displaced distal end 152 of the adjustment member. Surprisingly, the two different cigarette tube empty portions (of tube 200 and tube 200*a*) can be filled by this machine using a single throw distance corresponding to the movement of the sliding member from its rest position of FIGS. 4, 5A and 5B and the full fill position of FIG. 5G. Surprisingly, if the same process described above with respect to the cigarette tube 200 having a longer empty portion is followed, a properly filled cigarette tube will be obtained without any adjustment in the throw distance of the sliding member.

Figure 7:
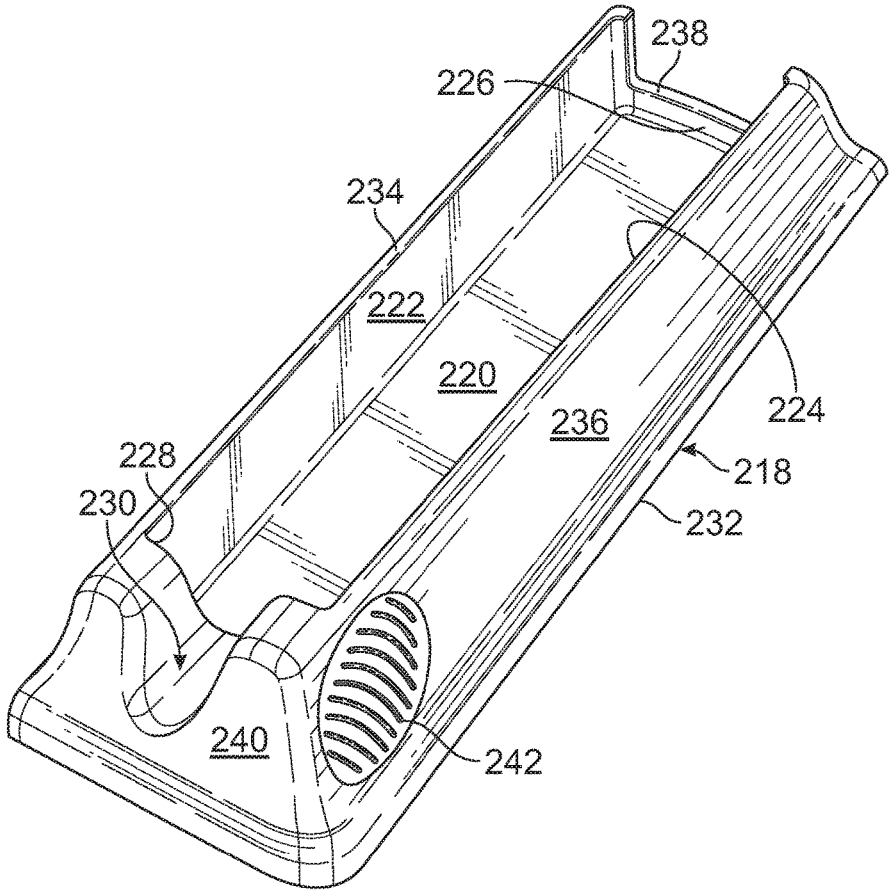
FIG. 7 is a perspective view of a base which may be used with a hand-held cigarette making machine like that of FIGS. 1-5F to enable the machine to be used as a tabletop cigarette-making machine.

A base 218 which may be used with hand-held cigarette making machine 10 is illustrated in FIG. 7. Preferably, the base is made from an elastomeric material like TPE rubber which is resilient and has a high coefficient of friction, although it may be made from any appropriate material. Also, although base 218 is configured to accept and be used with machine 10, it may be configured to accept and be used with any handheld cigarette making machine that is designed to be loaded with loose tobacco from the top and to longitudinally draw an empty cigarette tube over a compressed cylinder of tobacco formed by the machine.

Base 218 includes an elongated machine-receiving cavity 220 with lateral inner sidewalls 222 and 224, a back wall 226 and a front wall 228. Front wall 228 includes a preferably circular passage 230 dimensioned and positioned to enable a cigarette tube to move across the front wall during the tube filling process.

Base 218 has a support surface 232, lateral outer sidewalls 234 and 236 as well as a rear end wall 238 and a front end wall 240. It is preferred that the outer sidewalls, rear end wall and front end wall are angled away from machine-receiving cavity 220 to increase the size and hence surface area of support surface 232 to thereby increase the stability of the base. It is also preferred that outer sidewalls 234 and 236 be generally inwardly rounded as shown to facilitate gripping of the base during operation of the machine. Finally, the lateral outer sidewalls 234 and 236 include elliptical gripping areas 242 with raised lines as shown to facilitate gripping of the base during the operation of the machine.

Figure 8:
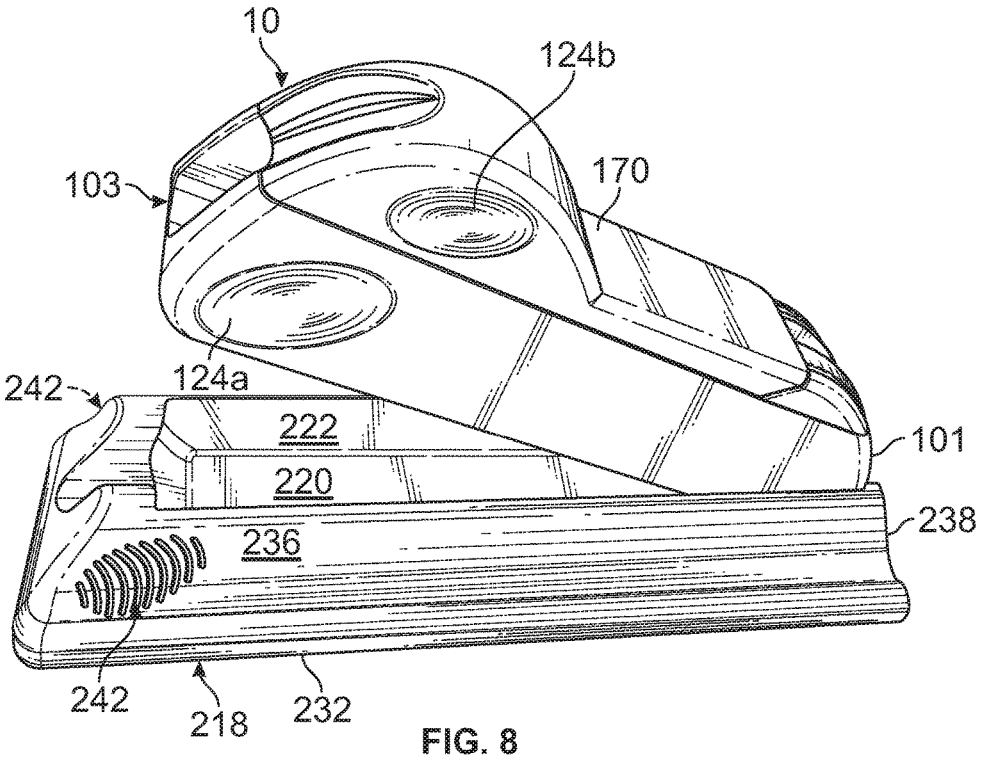
FIG. 8 is a perspective view of a a hand-held cigarette making machine being inserted into the base of FIG. 7.

Insertion of machine 10 into base 218 is illustrated in FIG. 8. As can be seen in this figure, the proximal end 101 of the machine may be inserted into base machine-receiving cavity 220 first and the machine is rotated downwardly. The downward motion of the machine is continued until the distal end 103 of the machine is fully received in the cavity. Insertion may alternatively begin at the distal end of the machine. When a preferred elastomeric material is used in the construction of the base, the retention of the machine in the base is enhanced by the friction between sidewalls 222 and 224 as well as back in front walls 226 and 228 and the corresponding outer surfaces of the machine.

Mounting the handheld machine in the base, converts it into a far more stable "tabletop" machine assembly. That is, rather than holding the handheld machine in the air or on a surface where it can readily move about during the introduction of tobacco and the tube filling operation, base 218 of the assembly may be placed on a tabletop or other appropriate support surface 242 (FIG. 10) where it will remain during the introduction of the tobacco and the tube filling operation. Where the base is made of an elastomeric material, the enhanced coefficient of friction of bottom surface 232 on the tabletop or other appropriate support surface helps minimize sliding of the assembly further enhancing the operation of the combined tabletop base and machine assembly.

Figure 4B:
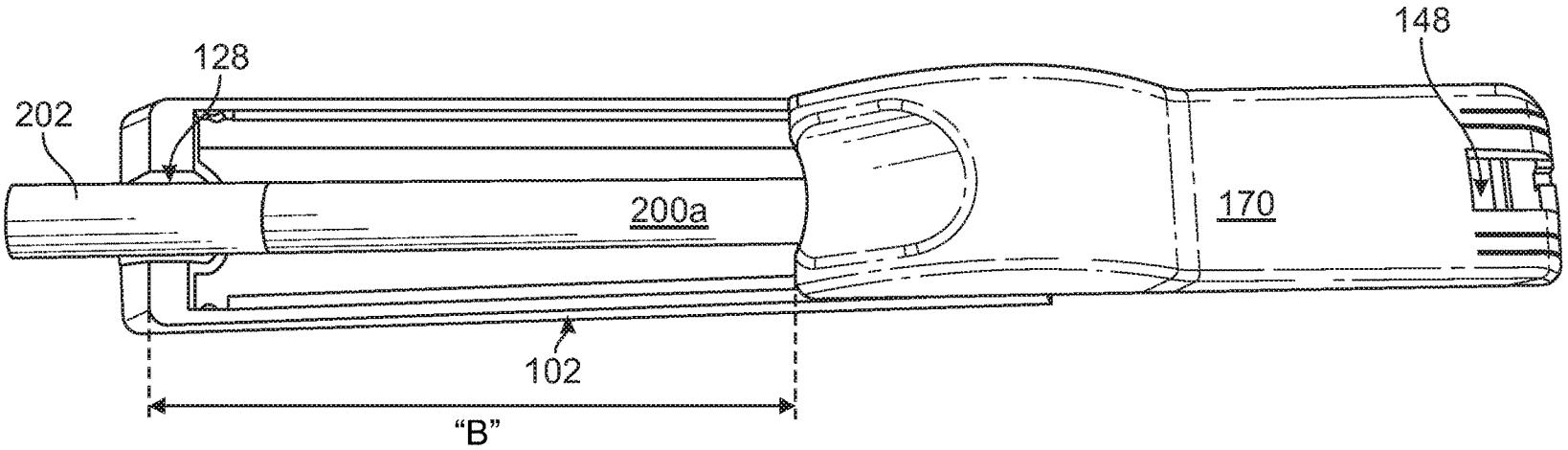
FIG. 4B is a top view of the fully assembled cigarette-making machine of FIG. 4A with its sliding member in its proximal filling position.
Figure 9:
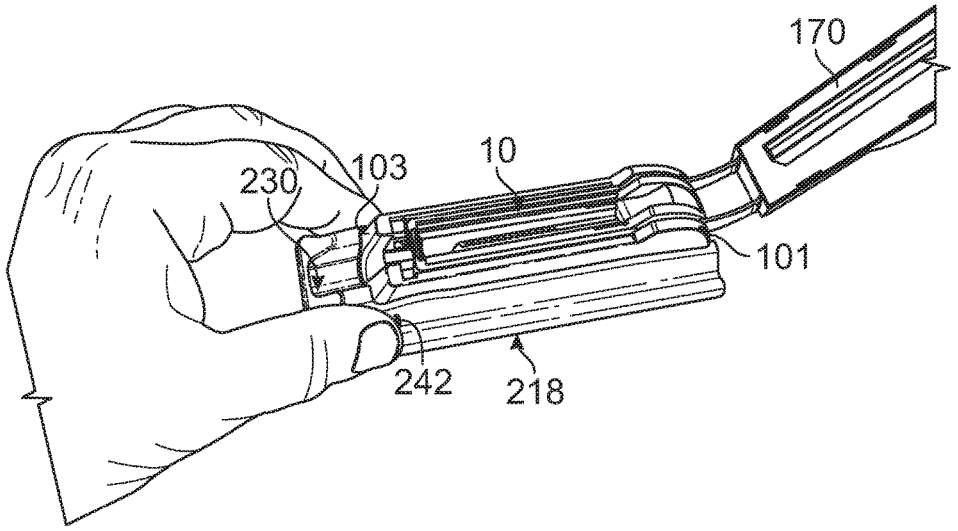
FIG. 9 is a perspective view of a hand-held cigarette making machine in accordance with embodiments mounted in the base of FIG. 7 with the machine opened to enable loose tobacco to be inserted.
Figure 10:
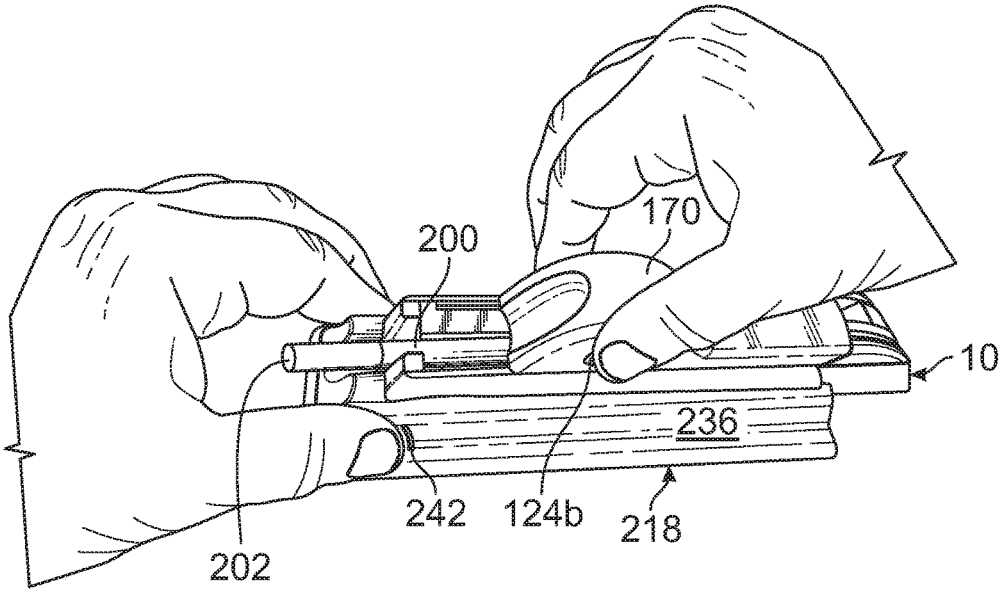
FIG. 10 is a perspective view of a hand-held cigarette making machine in accordance with embodiments mounted in the base of FIG. 7 with the machine being operated to fill an empty cigarette tube.

In FIG. 9, machine 10 mounted in base 218 is shown with pivoting top member 170 open, as in FIGS. 5A and 5E above, prior to insertion of loose tobacco into the tobacco receiving cavity of the machine as depicted in FIGS. 5B and 5F. As can be seen in this figure, the user may conveniently grip base 218 at gripping areas 242. Once the cavity is filled as appropriate and the loose tobacco tamped into place, the pivoting top member is closed and the machine is ready to be operated as depicted in FIG. 4B above. However, as shown in FIG. 10, the user conveniently grips base 236 at eliptical gripping areas 242 which stabilizes the tabletop base and machine assembly while the user also grips the machine at depressions 124*b* of the sliding member and moves the sliding member distally to draw cigarette tube 200 along the prepared and waiting tobacco within the machine, as explained above.

While particular embodiments of the invention are best shown and described above, various changes and modifications may be made therein without departing from the spirit and scope of the invention and, therefore, it is intended that the appended claims cover all embodiments and modifications which fall within the spirit and scope of the invention.

LISTING OF FEATURES IN THE FIGURES

| | |
|---|---|
| 100 | handheld cigarette making machine |
| 101 | proximal end of cigarette making machine |
| 102 | base |
| 103 | distal end of cigarette making machine |
| 104 | sliding member |
| 105 | sidewalls of sliding member |
| 106 | outwardly directed ribs of sliding member |
| 107 | slots for receiving outwardly directed adjustment member ribs |
| 108 | spoon |
| 109 | pair of holes in spoon |
| 110 | tobacco abutment member |
| 111 | distal face of abutment member |
| 112 | abutment pins |

-continued

| LISTING OF FEATURES IN THE FIGURES | |
|---|---|
| 113 | circular portion of abutment member |
| 114 | pin holder block |
| 115 | distal surface of pin holder block |
| 116 | holder block receiving cavity |
| 118 | inner sidewalls of base |
| 119 | bottom wall of base |
| 120 | inwardly directed ribs near bottom of inner sidewalls of base |
| 121 | inwardly directed ribs at the top of inner sidewalls of base |
| 124 | outer sidewalls of base |
| 124a | depression for grasping base |
| 124b | depression for grasping sliding member |
| 126 | front end of base |
| 128 | cigarette tube clearance slot |
| 132 | cigarette tube holding nipple assembly |
| 134 | throughhole in nipple |
| 136 | nipple side rails |
| 137 | nipple tube portion |
| 140 | nipple side rail receiving slots |
| 142 | tobacco receiving rectangular cavity in sliding member |
| 143 | bottom of tobacco receiving cavity |
| 144 | downwardly directed curved inner walls |
| 146 | internal sidewalls of sliding member |
| 147 | abutment surface of sliding member |
| 148 | adjustment member |
| 149 | tab abutment and of base rib |
| 150 | proximal end of adjustment member |
| 152 | distal end of adjustment member |
| 153 | hemispherical cut-out in distal end of adjustment member |
| 154 | hemispherical cut-out in proximal end of adjustment member |
| 155 | proximally facing top surface of adjustment member |
| 156 | distal abutment surface of adjustment member |
| 157a and 157b | outwardly directed adjustment member ribs |
| 158a and 158b | downwardly directed protuberances |
| 159a and 159b | vertically oriented proximal protuberance-receiving slots |
| 160a and 160b | distal protuberance-receiving slots |
| 162 | downwardly directed adjustment member stop |
| 163 | inner surface of proximal wall of sliding member |
| 165 | proximal wall of sliding member |
| 167 | slots in sliding member sidewalls for slidably receiving adjustment member ribs |
| 169 | endpoints of sliding member slots |
| 170 | pivoting top member of machine |
| 171 | stop projecting inwardly from sliding member internal sidewalls |
| 172 | pivot arms of top member |
| 174 | top front portion of pivoting top member |
| 176 | bottom surface of top member |
| 178 | elongated downwardly directed cigarette tamping member |
| 180 | concave elongated lower surface of tamping member |
| 182 | downwardly directed elastomeric cigarette tube holding member |
| 184 | concave surface of tube holding member |
| 186 | downwardly directed locking arms |
| 188 | outwardly directed catch members |
| 190 | slots to receive locking arms |
| 200 and 200a | empty cigarette tubes |
| 202 | cigarette filter |
| 204 | loose tobacco |
| 206 | tip of user's forefinger |
| 210 | tamper accessory |
| 212 and 214 | tamper edges |
| 216 | midsection |
| 218 | base |
| 220 | machine-receiving cavity |
| 222 and 224 | lateral sidewalls |
| 226 | back wall |
| 228 | front wall |
| 230 | front wall passage |
| 232 | bottom support surface |
| 234 and 236 | lateral outer sidewalls |
| 238 | rear end wall |

-continued

| LISTING OF FEATURES IN THE FIGURES | |
|---|---|
| 240 | front end wall |
| 242 | elliptical gripping areas |
| 244 | supporting surface |
| "A" | proximal movement of sliding member on base |
| "B" | full throw distance of sliding member |

I claim:

1. A handheld cigarette-making machine comprising:

a base;

a member mounted in the base for sliding longitudinally a throw distance between a distal loading position in which loose tobacco may be placed in the machine and a proximal filling position in which the tobacco fills an empty cigarette tube, the sliding member mounted in the base for sliding longitudinally having an elongated cavity for receiving loose tobacco and a cigarette tube holding assembly for attaching an empty cigarette tube;

a top member mounted to the sliding member for pivoting between an open position and a closed position, the top member having an elongated tamping member attached to its lower surface to compress loose tobacco in the sliding member cavity when the top member is pivoted to its closed position; and an adjustment member mounted in the sliding member for adjusting the length of the elongated cavity as necessary to fill empty cigarette tube tobacco-receiving portions of different lengths without varying the throw distance.

2. The handheld cigarette-making machine of claim 1 in which the base has an upstanding block and the sliding member has a surface aligned with the block to maintain the throw distance when the sliding member is moved to the proximal filling position.

3. The handheld cigarette-making machine of claim 1 in which the base has an inwardly directed rib with an abutment end and the sliding member mounted in the base for sliding longitudinally has an abutment surface aligned with the abutment end to maintain the throw distance when the sliding member is moved to the distal loading position.

4. The handheld cigarette-making machine of claim 1 in which the adjustment member has a distal face and the base has a tobacco abutment member with a distal end that cooperates with the adjustment member distal face to form a proximal end of the tobacco receiving cavity.

5. The handheld cigarette-making machine of claim 4 in which the tobacco abutment member has a circular portion and the adjustment member has a hemispherical cut-out in a distal end that rides along the surface of the circular portion of the tobacco abutment member as the sliding member is moved between the proximal filling position and the distal loading position.

6. The handheld cigarette-making machine of claim 1 in which the sliding member includes an elongated concave spoon and the tamping member has a concave elongated lower surface and the concave spoon and concave elongated lower surface cooperate when the top member is pivoted to its closed position to form a pressed tube of tobacco within the elongated cavity of the sliding member.

7. The handheld cigarette-making machine of claim 1 in which the elongated tamping member is of a fixed length.

8. The handheld cigarette-making machine of claim 1 in which the adjustment member is mounted for movement between a distal retracted position and a proximal fully open position.

9. The handheld cigarette-making machine of claim 8 in which the adjustment member has a downwardly directed protuberance and the sliding member has a sidewall with spaced slots for engaging the protuberance when the adjustment member is in its distal and proximal positions.

10. A method of filling an empty cigarette tube comprising:

providing a handheld cigarette-making machine for filling cigarette tubes with two different tobacco-receiving portion lengths where the machine has a base, a member mounted in the base for sliding longitudinally a throw distance between a distal loading position in which loose tobacco may be placed in the machine and a proximal filling position in which the tobacco fills an empty cigarette tube, the sliding member mounted in the base for sliding longitudinally having an elongated cavity for receiving loose tobacco and a cigarette tube holding assembly for attaching an empty cigarette tube, a top member mounted to the sliding member for pivoting between an open position and a closed position and having an elongated tamping member attached to its lower surface to compress loose tobacco in the sliding member cavity when the top member is pivoted to its closed position, and an adjustment member mounted in the sliding member for movement between a proximal fully open position and a distal retracted position for adjusting the length of the elongated cavity as necessary to fill empty cigarette tubes of the two different tobacco-receiving portion lengths without varying the throw distance;

positioning the sliding member in its distal loading position with the top member open and the adjustment member in its proximal position;

attaching an empty cigarette tube of a first tobacco-receiving portion length to the cigarette tube holding assembly;

placing loose tobacco in the tobacco receiving cavity;

closing the top member to compress the tobacco in the tobacco receiving cavity;

grasping the sliding member and moving it proximally while in the closed position to draw the empty portion of the cigarette tube along the compressed tobacco in the tobacco receiving cavity; and moving the sliding member to its distal loading position and removing the now filled cigarette tube from the machine.

11. The method of claim 10 in which the adjustment member is moved to its distal position and an empty cigarette tube of a second shorter tobacco-receiving portion length is attached to the cigarette tube holding assembly.

* * * * *